United States Patent [19]

Cockerham, Jr. et al.

[11] 4,362,001

[45] Dec. 7, 1982

[54] APPARATUS AND METHOD FOR WRAPPING AND SEALING CYLINDRICAL PACKAGES WITH A STRETCH FILM MATERIAL

[76] Inventors: C. C. Cockerham, Jr., 4620-A Mercury Dr.; John P. Nelson, 5306 W. Friendly Ave., both of Greensboro, N.C. 27410

[21] Appl. No.: 206,823

[22] Filed: Nov. 14, 1980

Related U.S. Application Data

[63] Continuation-in-part of Ser. No. 18,746, Mar. 8, 1979, abandoned.

[51] Int. Cl.[3] ..... B65B 11/04

[52] U.S. Cl. ..... 53/441; 53/465; 53/556; 53/587; 53/211; 53/380

[58] Field of Search ..... 53/441, 465, 211, 214, 53/380, 556, 587, 588

[56] References Cited

U.S. PATENT DOCUMENTS

| | | | |
|---|---|---|---|
| 602,150 | 4/1898 | Ball | 53/587 |
| 2,644,282 | 7/1953 | Irvine | 53/380 X |
| 2,681,534 | 6/1954 | Way | 53/214 X |
| 3,191,289 | 6/1965 | Fleischer | 53/211 X |
| 3,863,425 | 2/1975 | Edwards | 53/211 |
| 3,924,375 | 12/1975 | Brenner | 53/211 X |
| 3,986,611 | 10/1976 | Dreher | 53/441 X |
| 4,050,220 | 9/1977 | Lancaster | 53/556 |
| 4,077,179 | 3/1978 | Lancaster | 53/211 X |
| 4,136,501 | 1/1979 | Connolly | 53/559 X |
| 4,173,108 | 11/1979 | Elington | 53/587 |

FOREIGN PATENT DOCUMENTS 1243579 6/1967 Fed. Rep. of Germany ..... 53/380

*Primary Examiner*—John Sipos

*Attorney, Agent, or Firm*—Charles R. Rhodes; Judith G. Smith

[57] ABSTRACT

A cylindrical package to be wrapped with stretch film sheet material is supported on a pair of parallel, horizontally spaced, horizontally extending support rollers, one of which is rotatably driven and the other of which is a slave roll which rotates idly. A stretch film supply means is mounted on a movable carriage with the axis of the film supply means parallel to the axis of rotation of the package. The carriage is caused to reciprocate along a path parallel to the axis of rotation of the package and the support rollers. The reciprocation occurs between a first position where the film material extends beyond one end of the package a distance at least as great as the radius of the package and a second position where the film extends beyond the other end of the package a similar distance. The film material is wrapped while tension is applied thereto. The tensioning device is designed to vary pressure at the end portions of the carriage path in relationship to the intermediate portions, so that the overlapped portion of the stretch film material tends to fold in and seal the ends of the package. A post member extends across and adjacent to each end of the package to ensure folding in and sealing of the film material.

15 Claims, 9 Drawing Figures

APPARATUS AND METHOD FOR WRAPPING AND SEALING CYLINDRICAL PACKAGES WITH A STRETCH FILM MATERIAL

RELATED APPLICATIONS

The present application is a continuation-in-part of applicants' co-pending application, Ser. No. 18,746, filed on Mar. 8, 1979 now abandoned.

BACKGROUND OF THE INVENTION

The present invention relates to an apparatus and method for wrapping the periphery and sealing the ends of cylindrical packages with stretch film material. Such apparatus and method has particular applicability to large cylindrical package, such as rolled webs of filter material and other similar rolls of material in which it is important to not only wrap the periphery or sides, but also to seal the ends to prevent entry of moisture and dust into the package during subsequent shipment and storage.

The only known procedures for utilizing stretch film in such a wrapping procedure which completely seals the ends would be by use of apparatus similar to that shown in the Lancaster et al U.S. Pat. No. 3,867,806 in which the periphery is first wrapped, then separate caps are applied to the ends of the package, whereupon wrapping of the side then continues which seals the end caps thereto. Further, the stretch film material which is applied to the package must be of a width greater than the length of the package in the Lancaster et al patent, as is the case in all the other prior art known to the applicants.

SUMMARY OF THE PRESENT INVENTION

In its broadest sense, the invention is directed to a system of the type described in which the package to be wrapped is supported with the longitudinal axis thereof extending horizontally and wherein the package is supported for rotation by the application of a rotary driving force against the peripheral surface thereof with the ends free of any support mechanism. The leading edge of the film material is held against the side surface of the package as the package is rotated at a predetermined rate. At rotation of the package continues the film material is maintained under tension as it is pulled from a supply or dispensing means which, in turn, is reciprocated in a horizontal path parallel to the axis of rotation of the package from a first position in which the film extends beyond one end of the package and a second position in which the film extends beyond the other end of the package. The stretching of the film will create a tendency in the film to fold inwardly over the ends. Since the film extends beyond the package a distance greater than the radius of the package the film will be caused to turn in and fold down against the ends of the package forming a seal thereagainst. The electrostatic properties of the film or "cling" will assist in causing the film to fold in and seal the ends.

In a preferred embodiment the structure on which the package is mounted includes a pair of spaced, horizontally extending support rollers, one of which is driven against the periphery of the package and the other of which is idly rotated responsive to rotation of the package. The support rollers are spaced apart a distance smaller than the diameter of the package to be supported thereon so that the rollers are the sole means of rotation and support on the structure.

The stretch film material is delivered by a supply or dispensing means which is mounted on a carriage means which is movable in parallel relation to the axis of rotation of the package. The dispensing means may be a supply roll actually mounted on the carriage. Alternately the supply roll may be mounted elsewhere and film delivered to a dispensing means such as feed rollers or the like mounted on the carriage. The carriage means includes a track and means for moving the carriage back and forth along a path parallel to the horizontal axis of the package and the support rollers. In a preferred embodiment, the carriage is positioned between and underneath the two support rollers. Also, the carriage includes a variable tensioning means so that the tension of the film as it is applied to the roll may be varied, preferably so that a selectively greater, but in some situations a lesser tension is applied at the ends of the package to cause the turning in and sealing characteristic to be achieved.

To ensure that the overlapped film material turns in and seals against the ends of the package, a bar is mounted on a post which extends across and closely adjacent to each of the ends of the package. So arranged, as the film material is wrapped beyond the end of the package the bar urges or attracts the film material toward the axis of rotation and into engagement with the ends of the package and layers of the material therebeneath to perfect the seal.

It is therefore an object of the present invention to provide an improved method and apparatus for wrapping and sealing cylindrical packages.

It is another object of the present invention to provide an improved method and apparatus of the type described in which a continuous length of stretch film material is used to wrap the periphery and seal the ends of cylindrical packages.

Other objects and a fuller understanding of the invention will become apparent from reading the following detailed description of a preferred embodiment, taken in conjunction with the accompanying drawings in which.

DETAILED DESCRIPTION OF A PREFERRED EMBODIMENT

Figure 1:
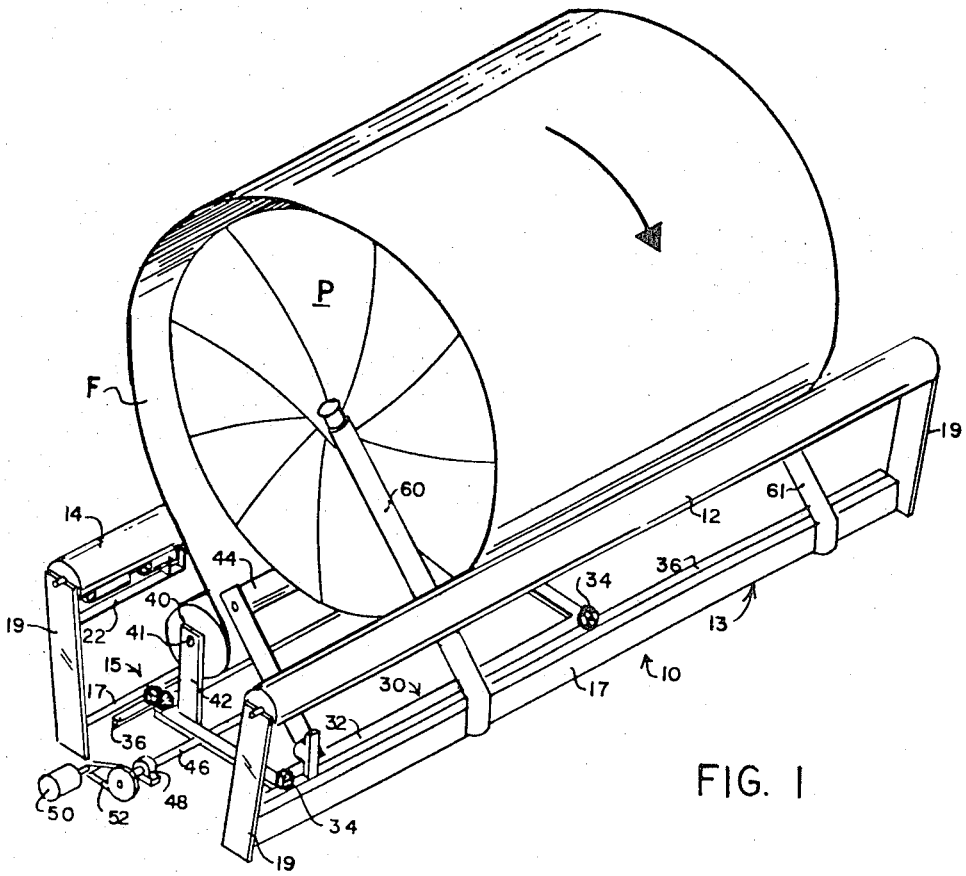
FIG. 1 is a perspective view of the apparatus according to the present invention having a cylindrical package mounted thereon in the process of being wrapped.
Figure 2:
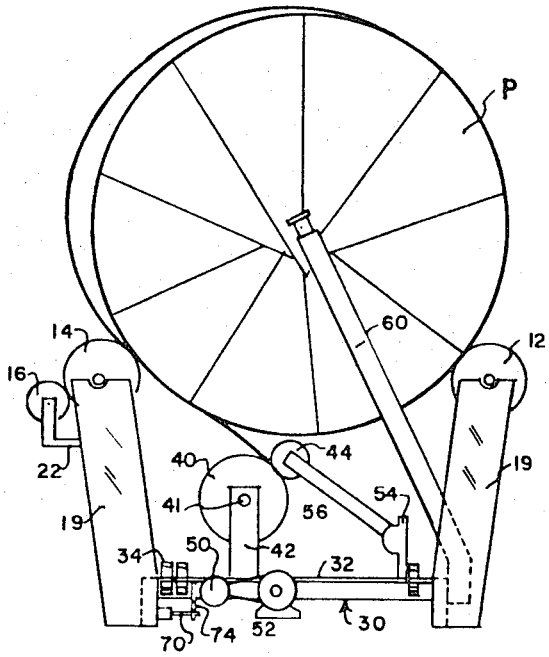
FIG. 2 is an end view of the apparatus shown in FIG. 1.
Figure 3:
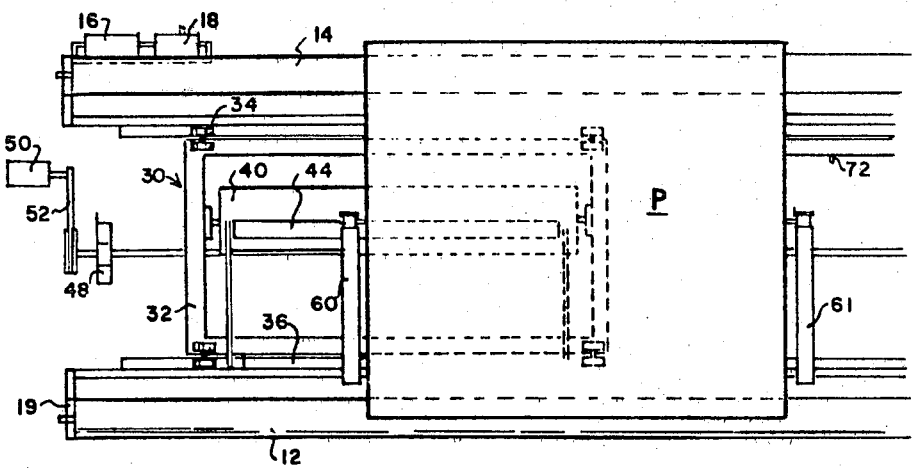
FIG. 3 is a plan view with the cylindrical package removed from the apparatus.
Figure 4:
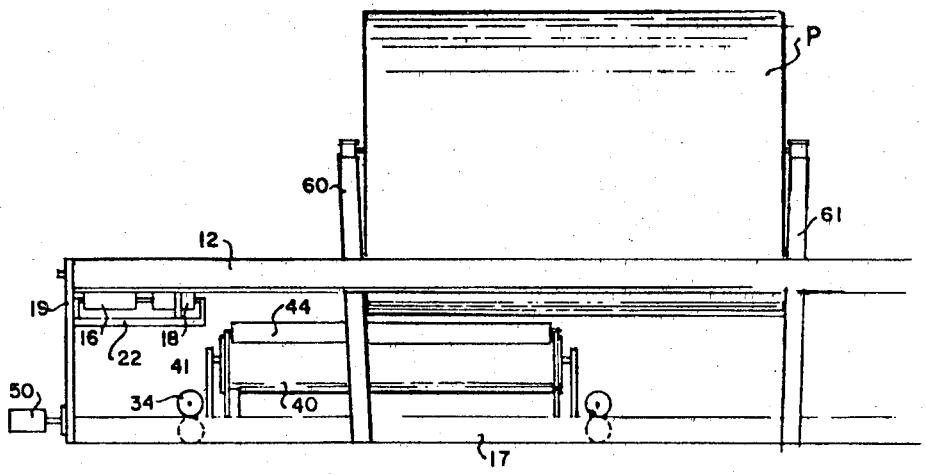
FIG. 4 is a side view of the apparatus illustrated in FIG. 1.

Turning now to a discussion of the illustrated embodiment in FIGS. 1-4, it should first of all be pointed out that the apparatus 10 of the present invention is adapted for use in wrapping a cylindrical package P with a continuous length or sheet of film material F which is dispensed from a roll 40. In general, package P is supported on a pair of parallel, horizontally spaced, horizontally extending support rollers 12,14; support roller 12 being rotatably driven by a drive roller 16 and the other support roller 14 being a slave roller which rotates idly responsive to rotation of package P. The film or sheet material F is carried by a roll 40 which in turn, as illustrated in the drawings of the preferred embodiment, is mounted on a reciprocal carriage 30 and caused to reciprocate along a horizontal path parallel to the longitudinal axis of the package 10 and the support rollers 12,14. As noted hereinabove the roll 40 of film might be mounted elsewhere and delivered to a supply or dispensing means on the carriage. Carriage 30 moves between a first position where the film material F overlaps or extends beyond one end of the package a distance at least as great as the radius of the package and a second position wherein the film overlaps the other end of the package a similar distance. Film F is maintained under tension by a tension roll 44 which is caused to move in an arcuate path for increasing or decreasing the tension on the film as it is applied to the ends of the package P in relationship to the tension applied during the wrapping of the intermediate portion of package P. If the tension is increased, the overlapped portion of the stretch film material 10 is automatically caused to fold in and seal the ends of the package. If the tension is decreased, there will still be some natural folding in of the ends of the film. However, to ensure folding, a bar member 60 is preferably provided which extends across and adjacent to each end of the package P. The bar member 60 mechanically urges the film to seal as well as attracting the film toward the axis by an electrostatic buildup in the bar.

Looking at each part in more detail, first of all there is provided a pair of side frame member 13,15 each of which includes an elongated bar 17 from which a pair of end plates 19 extend upwardly and slightly outwardly. Support roller 12 is journaled at its opposite ends to bearings on the upper edge of one set of the upwardly extending plates 19. Support roller 14 is likewise journaled into bearings at the upward edges of the similar set of plates 19 on frame member 15. A small bracket 22 is mounted on frame 15 and supports a drive motor 18 and a drive roll 16 connected to the output shaft of motor 18 and positioned in engagement with the surface of support roller 12 for the driving thereof. This is a conventional technique for causing a roll to turn and it is not believed that further elaboration is necessary. Other conventional means for driving one of the support rollers 12 are also possible, such as a motor having the output shaft thereof connected directly to the support rollers by means of some type of reducer.

An inverted, L-shaped angle member 36 is attached to the upper inner surface of each of the frame bars 17 for providing a track-like support for carriage 30 as will be explained hereinafter. Carriage 30 includes a rectangular frame member 32 formed of a plurality of angle members welded together at the ends thereof. A roller member 34 extends outwardly from a bearing in each corner thereof and supports the carriage from opposed angle members 36 for reciprocal movement therealong beneath package P. An upstanding place 42 secured to the frame 32 at each end thereof provides support for the roll 40 of film material F. It should be recognized that roll 40 is journaled into a bearing 41 at the upper end of each plate 42.

An elongated threaded rod 46 is mounted in bearing block 48 at either end thereof and extends longitudinally beneath the apparatus 10 in parallel relationship to the axis of rotation of package P and of support rollers 12,14. Threaded rod 46 extends through openings in carriage frame 32, which openings are threaded to mate with the threads on rod 46. Therefore as the rod 46 is rotated the carriage 30 is caused to reciprocate back and forth beneath the cylindrical package P being wrapped. Rotation of the threaded rod 46 is caused by a reversible motor 50 which is operably connected to the end of the threaded rod by means of a pulley and belt assembly 52. Reversal of motor 50 is activated by a pair of sensing means such as limit switches 70,72 adjustably mounted for positioning along one of tracks 36 at each end of and in the path of cams 74 depending from carriage 30. Of course limit switches 70,72 are electrically connected to motor 50. As an alternative to mechanically activated limit switches, the sensing means could take the form of photoelectric or light sensitive switches which would sense the location of carriage 30 relative to the ends of package P.

A pivot arm 56 is pivotally attached to another upstanding plate 54 on carriage 30 by means of a voltage activated clutch plate, such as a Warner clutch plate. Pivot arm 56 extends upwardly and transversely across the carriage to rotatably support a tension roll 44 in engagement with the surface of film package 40, or possibly even in engagement with the film after it leaves the package. Either way would be satisfactory to apply tension to the film. As stated hereinabove, the tension is varied in accordance with a pre-planned program. Toward this end, when the carriage 30 reaches the end of its path, the sensing means activates a change of voltage applied to the clutch plate to increase or decrease the tension of tension roll 44 against package 40. Then when the sensing means (limit switch 70,72) is released, the applied voltage reverts to the original valve tension. For those skilled in the art, tension roll 44 is actually an electric brake device.

Although in most wrapping processes it may be preferred to increase the tension on the wrapping material to encourage sealing of the ends of the package, there are at least two instances when it is desirable to decrease tension. The first instance occurs when, on occasion, the angle of the film roll 40 or supply means is changed with relationship to the package P. When such occurs the tension on film F would preferably be decreased to make adjustment for the natural increase in tension on one edge of the film due to changing the angle of the film roll 40.

The second instance occurs when it is necessary to decrease tension on the film roll 40 to increase the tackiness of the film surface. In many cases tension is applied to the film roll to such a degree that the surface glazing cracks and its ability to adhere to itself is decreased. Therefore, in order to assure sealing of the ends, the tension must be decreased to preserve tackiness and sealing capabilities.

An upstanding post 60 whose axis is stationary, but which rotates about its own axis is attached at one end to the bar 17 of frame member 15 and extends upwardly toward the center of the end of package P to a point just past the center. A second post 61 performs the same function at the opposite end of package P. Posts 60,61 are so made that they may be adjusted longitudinally of the elongated bar 17 for positioning for use with packages of various length. Further it has been found that the bar 60 should preferably be so adjusted that a side portion thereof engages the edge of the package being wrapped and the tip is slightly spaced from the end surface. It is believed that this causes the bar to acquire an electrostatic charge which pulls the film toward the center of the side surface. This arrangement of bars 60,61 then ensures complete sealing of the ends.

The type of film for which the apparatus is designed is preferably a polyvinylchloride film which is commonly known as a stretch film. Other stretch films are available. Further, the width of the film (or length of the film roll) is selected to be such a dimension that the overlap is slightly greater than the radius of the package to be wrapped. This ensures that the film material will cover the ends and seal without leaving a hole into which moisture and/or dust could enter.

In use, the package to be wrapped is placed on support rollers 12,14 with the axis thereof extending horizontally and oriented for rotation by applying a driving force through drive roll 16 and roller 12 against the side surface of the package P. So arranged the ends of the package P are free to any support mechanism so that a complete seal may be made therearound. The free end of the film F from package 40 is moved up and laid against the side surface of package P at any point therealong, whereupon rotation of the package commences. As rotation continues, reversible motor 50 causes the threaded rod 46 to turn and the carriage to reciprocate back and forth between a first position in which the film overlaps one end of the package and the second position in which the film overlaps the other end of the package. As the film moves out across the ends of the package a distance at least as great as the radius of the package a combination of the variance in tension on the film and the electrostatic charge from bars 60,61 present as the film is moved across the bar tend to cause the film to fold in and seal around the ends of the package. The carriage then reverses itself and moves longitudinally back to the other end of the package passing through an intermediate phase where the tension is adjusted for wrapping up the side surface, then again adjusted by increasing or decreasing as the opposite end is reached, whereupon the same end wrapping technique ensues.

While a preferred embodiment of the present invention has been described hereinabove it is apparent that various changes and modifications might be made to the specific structure described without departing from the scope of the invention which is to be limited solely by the following claims.

What is claimed is:

1. A method of wrapping the periphery and sealing the ends of cylindrical packages with stretch film comprising the steps of:

(a) supporting the cylindrical package with the longitudinal axis horizontally oriented;

(b) rotating said package by applying a driving force against the side surface thereof;

(c) applying the free end of a sheet of stretch film material delivered from a supply means of such material to the side surface of said package as said package is turning;

(d) as rotation of said package continues, moving said supply means of film material back and forth in a horizontal path parallel to the axis of rotation of said package from a first position in which said film overlaps one end of said package a distance greater than the radius of said package and a second position in which said film overlaps the other end of said package a distance greater than the radius of said package, while applying tension to said film to stretch it as it is wrapped on the package, and automatically applying varied tension to said film such that a prescribed tension is applied at the ends of the path to turn said film toward said longitudinal axis of the article to thereby cover the ends of the article, and automatically applying a different tension during the wrapping of the package in the intermediate portion of the path.

2. The method according to claim 1 wherein said tension is varied with greater tension being applied at the ends of the path than during the wrapping of the package in the intermediate portion of the path.

3. The method according to claim 1 wherein said tension is varied with lesser tension being applied at the ends of the path than during the wrapping of the package in the intermediate portion of the path.

4. Apparatus for wrapping the peripheral surface and sealing the ends of cylindrical packages with stretch film comprising:

(a) a pair of rotatable support rollers horizontally spaced apart a distance less than the diameter of said cylindrical packages whereby said packages may be laid on and supported by said rollers;

(b) drive means associated with said apparatus for rotating said packages, when mounted, at a predetermined rate;

(c) means for rotatably supporting a supply means of stretch film material adjacent said support rolls, the longitudinal axis of said supply means of sheet material being substantially parallel to the longitudinal axis of said cylindrical package when positioned on said support rollers;

(d) means for causing relative movement between said package and said supply means of stretch film material along a path parallel to the longitudinal axis of said cylindrical package from a first position where said stretch film overlaps one end of said cylindrical package a distance greater than the radius of said package, and a second position where said film overlaps the other end of said cylindrical package a distance greater than the radius of said package; and (e) tensioning means associated with said supply means for applying a prescribed variable tension on said film to stretch it as it is wrapped onto said cylindrical package;

(f) activating means to control the tensioning means to automatically apply a prescribed force at said first and second positions to turn said film toward said longitudinal axis of the article to thereby cover said ends of the article, and to automatically apply a different force at points therebetween during the wrapping operation of cylindrical package.

5. The apparatus according to claim 4 wherein said drive means includes a drive roll mounted for rotation and having the periphery thereof engagable with the periphery of at least one of said support rollers, motor means for causing rotational motion of said drive roll which is transmitted to the support roller engaging said drive roll.

6. The apparatus according to claim 4 wherein said means for rotatably supporting said supply means comprises a carriage mounted beneath and between support rolls.

7. The apparatus according to claim 6 wherein said carriage includes a rectangular frame having sides and ends, a bearing plate extending upwardly from opposite ends of said frame on which said supply means is rotatably mounted.

8. The apparatus according to claim 6 wherein said means for causing relative movement between said package and said supply means comprises a plurality of wheels attached to and extending outwardly from opposite sides of said carriage, a pair of tracks or rails associated with said apparatus and extending in spaced parallel relation to each other and parallel to the longitudinal axis of said cylindrical package, said carriage being supported on said pair of rails by said wheels, and said activating means comprises means for causing reciprocal movement of said carriage back and forth along said path between said first and second positions.

9. The apparatus according to claim 8 wherein said means for causing reciprocal movement of said carriage comprises a threaded rod extending parallel to and between said rails, a threaded opening through said carriage corresponding to the threads on said threaded rod and receiving said threaded rod, a reversible motor means attached to said threaded rod for rotation thereof, whereby rotation of said threaded rod causes a movement of said carriage along said path.

10. The apparatus according to claim 8 wherein said activating means comprises a sensing means for determining the pressure of said carriage at each of first and second positions.

11. The apparatus according to claim 4 wherein said tensioning means comprises a brake device in engagement with the film on said supply means.

12. The apparatus according to claim 11 wherein said brake engages the film on said supply means with greater force at said first and second position than at points therebetween.

13. The apparatus according to claim 11 wherein said brake engages the film on said supply means with lesser force at said first and second position than at points therebetween.

14. The apparatus according to claim 4 wherein a post is attached to said apparatus adjacent each end of said package in confronting relation thereto and in engagement with the edge portion of said package being wrapped, but slightly spaced from the ends of said package near the axis of rotation, said post extending past the axis of revolution whereby said end sealing is ensured by the electrostatic attraction of said film toward the axis of said package as exerted by the free end of said post and the pressing of the post against the overlapped portion of said film.

15. The apparatus according to claim 14 wherein said posts are adjustably attached to said apparatus for repositioning thereof depending on the length of said package being wrapped.

* * * * *